US008898870B2

(12) United States Patent
Chan

(10) Patent No.: US 8,898,870 B2
(45) Date of Patent: Dec. 2, 2014

(54) DUAL LOCKING BUCKLE ASSEMBLY

(71) Applicant: Duraflex Hong Kong Limited, Hong Kong (CN)

(72) Inventor: Yick Fai Chan, Hong Kong (CN)

(73) Assignee: Duraflex Hong Kong Limited, Hong Kong (HK)

( * ) Notice: Subject to any disclaimer, the term of this patent is extended or adjusted under 35 U.S.C. 154(b) by 0 days.

(21) Appl. No.: 13/739,265

(22) Filed: Jan. 11, 2013

(65) Prior Publication Data

US 2014/0196262 A1 Jul. 17, 2014

(51) Int. Cl.
*A44B 11/25* (2006.01)

(52) U.S. Cl.
CPC ..... *A44B 11/25* (2013.01)
USPC ..... 24/589.1; 24/197

(58) Field of Classification Search
USPC ..... 24/193, 196, 197, 200, 163 R, 182, 171, 24/170, 168, 315, 593.1, 589.1
See application file for complete search history.

(56) References Cited

U.S. PATENT DOCUMENTS

| | | | | | |
|---|---|---|---|---|---|
| 1,338,850 | A | * | 5/1920 | Bear | 24/315 |
| 2,784,472 | A | * | 3/1957 | Freysinger | 24/197 |
| 2,853,757 | A | * | 9/1958 | Rave | 24/197 |
| 2,983,015 | A | * | 5/1961 | Harley | 24/171 |
| 3,060,537 | A | * | 10/1962 | Hatfield | 24/197 |
| 3,165,802 | A | * | 1/1965 | Irvin | 24/197 |
| 3,231,953 | A | * | 2/1966 | McHenry | 24/197 |
| 3,349,449 | A | * | 10/1967 | Hatfield | 24/197 |
| 3,355,744 | A | * | 12/1967 | Wilson | 2/338 |
| 3,439,388 | A | * | 4/1969 | Barlow | 24/197 |
| 4,751,772 | A | * | 6/1988 | Crowle | 24/170 |
| 5,205,021 | A | * | 4/1993 | Durand | 24/163 R |
| 5,471,714 | A | * | 12/1995 | Olson | 24/171 |
| 7,461,435 | B2 | * | 12/2008 | Brown | 24/200 |

FOREIGN PATENT DOCUMENTS

| | | |
|---|---|---|
| KR | 30-0624835 | 12/2011 |
| KR | 30-0624864 | 12/2011 |
| KR | 30-0624878 | 12/2011 |
| KR | 10-2012-0121956 | 11/2012 |

* cited by examiner

*Primary Examiner* — Robert J Sandy
*Assistant Examiner* — Abigail Morrell
(74) *Attorney, Agent, or Firm* — Collard & Roe, P.C.

(57) ABSTRACT

A buckle assembly has a base portion with a strap retaining bar and an inner opening disposed between the side walls, and a locking portion having a strap retaining bar and a protrusion extending outwardly from each of the side walls. The length of the locking portion is greater than the length of the opening, and the width of the opening is wider than the width of the locking portion. The side walls of the base portion each have a slot arranged to accommodate the protrusions on the locking portion when the locking portion is placed on the base portion. The locking portion is connected to the base portion by sliding the locking portion through the opening from the bottom side to the top side of the base portion, aligning the locking portion to extend parallel to the base portion, and snapping the protrusions into the slots.

4 Claims, 5 Drawing Sheets

DUAL LOCKING BUCKLE ASSEMBLY

BACKGROUND OF THE INVENTION

1. Field of the Invention

The present invention relates to a dual locking buckle assembly for attaching two straps together. In particular, the invention relates to buckle assembly in which both straps can be adjusted and which can be released easily.

2. The Prior Art

Buckles for attaching two straps together are often used on belts, backpacks and luggage. It is desirable to have the straps be adjustable and the buckle be releasable without losing the positioning of the straps. It is also important that the buckle be easily releasable but not release inadvertently under sudden lateral pressure.

One buckle that achieves these goals is disclosed in Korean Patent Application Publication No. 10-2012-0121956. In this application, there is a main buckle part connected to a strap. This main buckle part can be locked to a locking port connected to a second strap. The locking port is attached to the main buckle portion via hinge stoppers which lock into slots on the main body, and by additional protrusions on the main body that lock into slots on the locking port. The buckle can only be released by pivoting the locking port up and away from the main body and sliding the locking port behind the main body.

While this buckle is effective in locking the two parts together, it requires that the two parts be snapped together via the additional protrusions in order to prevent separation of the two parts. This often requires two hands, because the parts are pivoting with respect to each other around the hinge stoppers. It would be desirable to create a buckle having a small number of protruding parts, to reduce wear and breakage of the buckle and to develop a buckle that can be simply and easily locked together.

SUMMARY OF THE INVENTION

It is therefore an object of the invention to provide a buckle having a single, simple locking mechanism, in which the parts can be connected to each other easily, and which cannot become inadvertently separated.

These and other objects are accomplished by a buckle assembly having a base portion and a locking portion adapted to be connected to the base portion. The base portion has a top surface, a bottom surface, side walls, a strap retaining bar disposed between the side walls, and an inner opening disposed between the side walls. The inner opening has a width extending between the side walls and a length extending perpendicular to the width.

The locking portion has opposing side walls, a strap retaining bar, and a protrusion extending outwardly from each of the side walls. The locking portion has a width extending from one of the side walls to the other, and a length extending perpendicular with the width of the locking portion. The length of the locking portion is greater than the length of the opening in the base portion, and the width of the opening at a widest point is wider than the width of the locking portion at a widest point. This way, the locking portion can be slid entirely through the opening of the base portion by positioning the locking portion perpendicular to the base portion and sliding the locking portion from underneath the base portion to above the base portion. The locking portion can then be connected to the base portion by positioning the locking portion parallel to the base portion, so that the locking portion can no longer fit through the opening, as the length of the base portion is greater than the length of the opening. This creates a first level of locking, where the locking portion cannot be separated from the base portion inadvertently.

The side walls of the base portion each have a slot arranged to accommodate the protrusions on the locking portion when the locking portion is placed on a top surface of the base portion. This way, when the locking portion extends parallel to the top side of the base portion, the protrusions can be snapped into the slots to secure the locking portion to the base portion. This creates a second level of locking, to ensure that the locking portion cannot be disengaged from the base portion, even when there is no tension on the straps connected to the base portion and locking portion.

Preferably, the side walls of the base portion have an inner contour that corresponds to a shape of an outer contour of the locking portion, so that the locking portion seats within the side walls of the base portion when the base portion and locking portion are locked together. This makes it very easy to connect the base portion and locking portion together, because the locking portion is automatically forced into the correct orientation for being snapped into place. The two portions can thus be easily locked together using only one hand, either to lock the locking portion directly, or to pull on a strap connected to the locking portion, as explained in further detail below.

In one embodiment, the strap retaining bar of the base portion is disposed at one end of the base portion and the strap retaining bar of the locking portion is disposed across the middle of the locking portion, extending between the side walls of the locking portion. The locking portion is preferably configured with a cavity in between the side walls, and the strap retaining bar bisects the cavity. This way, the strap can extend up and around the strap retaining bar, with the ends extending through the cavity on either side of the strap retaining bar.

In a further embodiment, there are two additional protrusions disposed one each on the interior of the side walls of the locking portion adjacent the strap retaining bar. Feeding the strap between the strap retaining bar and the, additional protrusions causes the strap to press against the protrusions and keep the strap in place during manufacturing and assembly of the buckle portion. By pressing on the strap edge regions, the protrusions cause a "belly" to be created in a middle region of the strap, which bows out away from the strap retaining bar. This bowed configuration prevents any slippage of the strap during assembly. In addition, the protrusions allow for easier assembly, because the strap can be sewed prior to insertion in to the locking portion, due to the extra room created by not having a narrower slot or an additional strap retaining bar.

In use, a strap is disposed over the strap retaining bar of the locking portion, such that when the locking portion is connected to the base portion, the ends of the strap extend through the cavity of the locking portion and the cavity of the base portion. This way, pulling the strap ends in a direction parallel to the top and bottom surfaces of the base portion and locking portion causes the protrusions to snap into the slots and lock the locking portion to the base portion. Pulling on the straps forces the locking portion downward onto the base portion, because the strap on the locking portion extends through the base portion as well. Thus, tension on the straps causes the locking portion to automatically lock into the base portion and prevents any inadvertent disengagement. When the tension on the straps is completely released, the locking portion be easily disengaged from the base portion. To disengage the locking portion from the base portion, the locking portion must be pivoted to be substantially perpendicular to the base portion so that it can fit though the opening in the base portion.

In another embodiment, the base portion has an indentation on an end opposite the end having the strap retaining bar. This indentation allows the locking portion to overhang the base portion when the two portions are locked together, and allows the locking portion to be easily disengaged from the base portion by pushing upward on the locking portion.

The present invention is an improvement over prior buckles, because it is simple to engage and disengage, but absolutely prevents inadvertent disengagement, both while under tension and when tension is released. Straps can be easily added and sewn onto the buckle portions while the portions are attached to each other, thus facilitating manufacture and assembly. In addition, because there are no large protruding pieces, the buckle portions cannot be easily broken.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE EMBODIMENTS

Figure 1:
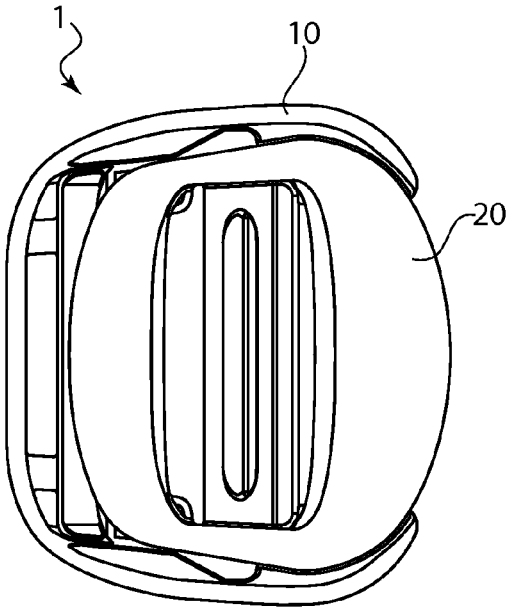
FIG. 1 shows a top view of one embodiment of the buckle assembly according to the invention.
Figure 1A:
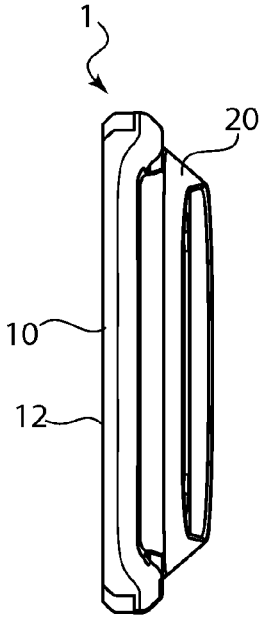
FIG. 1A shows a side view of the buckle assembly of FIG. 1.
Figure 2:
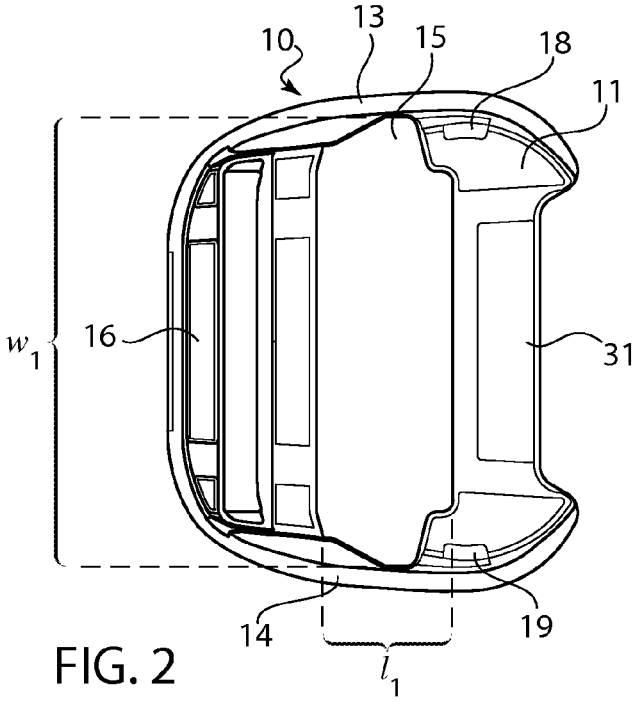
FIG. 2 shows a top view of the base portion.
Figure 2A:
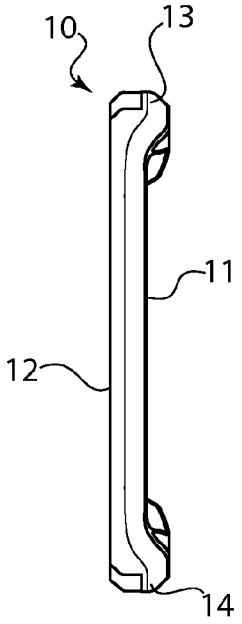
FIG. 2A shows a side view of the base portion.

Referring now in detail to the drawings, FIGS. 1 and 1A show the buckle assembly 1 according to the invention in an assembled state. Buckle assembly 1 comprises a base portion 10 and a locking portion 20, which engages on a top surface of base portion 10. FIGS. 2 and 2A shows base portion 10, which has a top surface 11, a bottom surface 12, and two raised side walls 13, 14. In between side walls 13, 14 is an opening 15, which has a width $w_1$ and a length $l_1$. At the end of base portion 10 is a strap retaining bar 16 for securing a strap to base portion 10.

Figure 3:
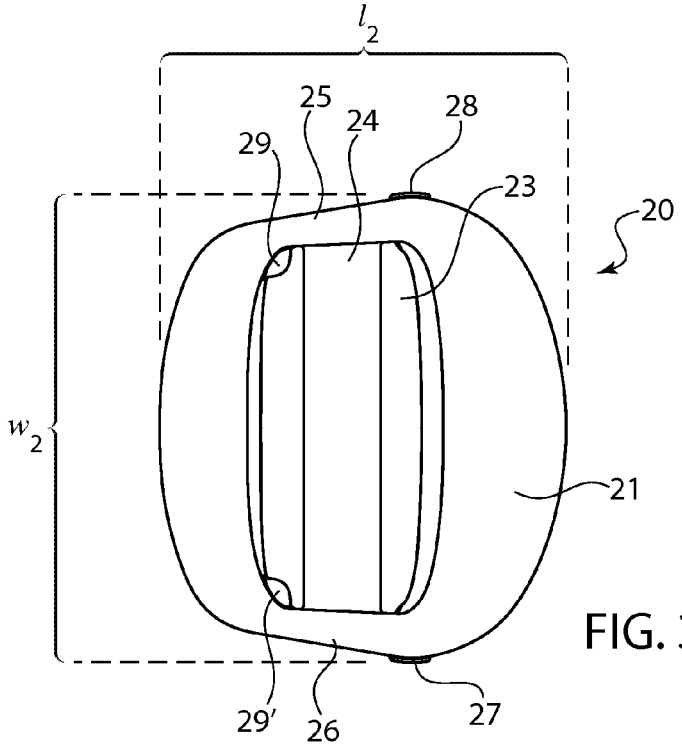
FIG. 3 shows a top view of the locking portion.

FIG. 3 shows locking portion 20, which has a top surface 21, a bottom surface, side walls 25, 26, a cavity 23 between side walls 25, 26, and a strap retaining bar disposed across cavity 23 between side walls 25, 26. On the exterior of side walls 25, 26, there are protrusions 27, 28. Locking portion 20 has a width $w_2$ and a length $l_2$.

Width $w_1$ of opening 15 in base portion 10 is greater than width $w_2$ of locking portion 20, and length $l_2$ of locking portion 20 is greater than length $l_1$ of opening 15. This allows locking portion 20 to be inserted entirely through opening 15 of base portion 10 when locking portion 20 is disposed substantially perpendicular to base portion 10, but prevents locking portion 20 from going through opening 15 when locking portion 20 is disposed parallel to the top surface of base portion 10.

Figure 4:
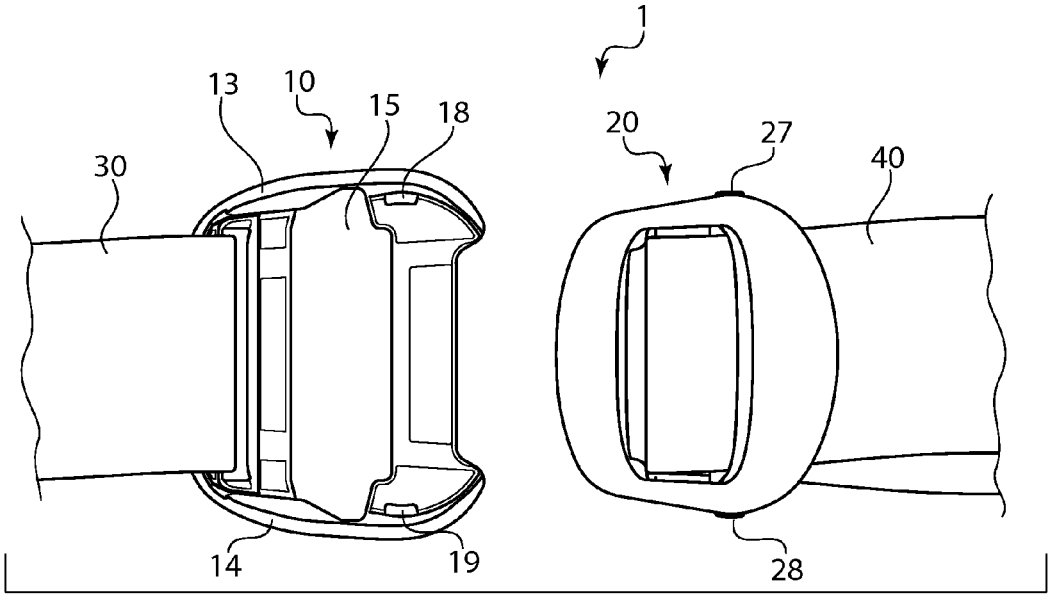
FIG. 4 show the two portions with strap attached and separated from each other.
Figure 5:
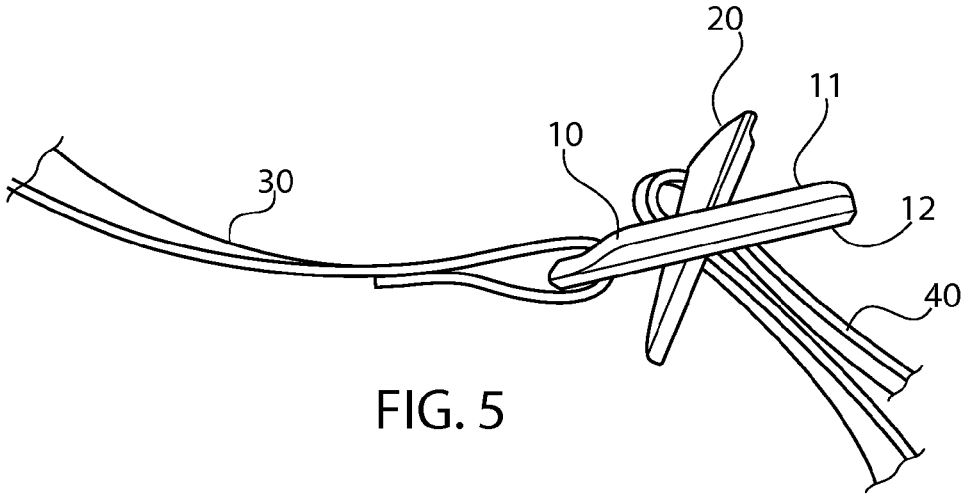
FIG. 5 shows the locking portion being inserted into the base portion.

FIGS. 4-8 show the process of connecting base portion 10 to locking portion 20. Base portion 10 is connected to a strap 30, which is sewn around strap retaining bar 16. Locking portion 20 is connected to strap 40, which is threaded around strap retaining bar 24. The buckle assembly 1 according to the invention is used to connect two straps together in a manner that prevents inadvertent disengagement under stress, yet is simple to engage and disengage. FIG. 4 shows the two portions 10, 20 prior to engagement. To connect base portion 10 and locking portion 20, locking portion 20 is inserted through opening 15 from under bottom surface 12 of base portion 10, as shown in FIG. 5. Locking portion 20 slides easily through opening 15, because the width $w_1$ of opening 15 is greater than the width $w_2$ of locking portion 20, as explained above.

Figure 6:
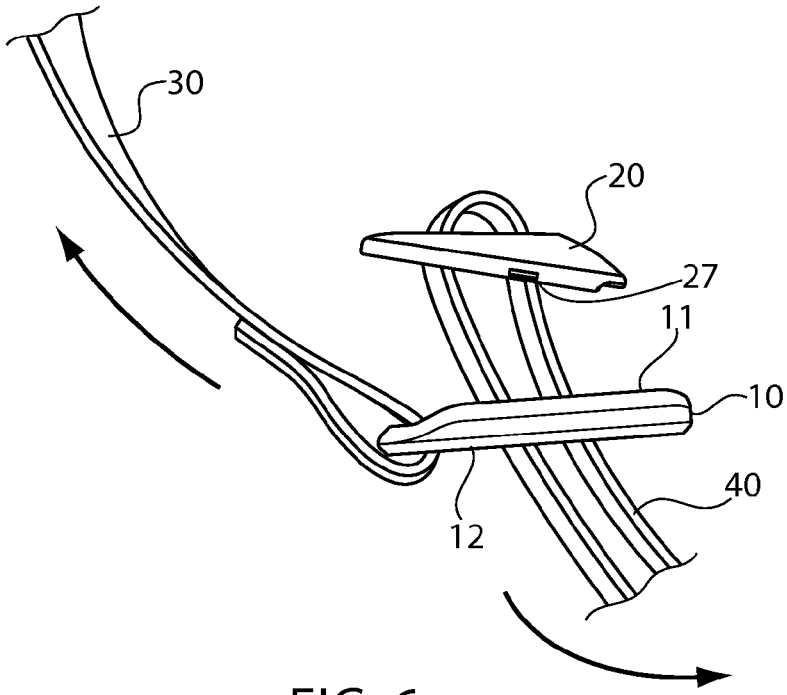
FIG. 6 shows the locking portion after insertion through the base portion and prior to locking.

Once locking portion 20 passes entirely through base portion 10 so as to be above top surface 11 of base portion 10 (as shown in FIG. 6), locking portion 20 can be easily and securely connected to base portion 10 simply by pulling on straps 30 and 40. Strap 40 extends all the way through both locking portion 20 and base portion 10, while strap 30 only contacts base portion 10.

Figure 7:
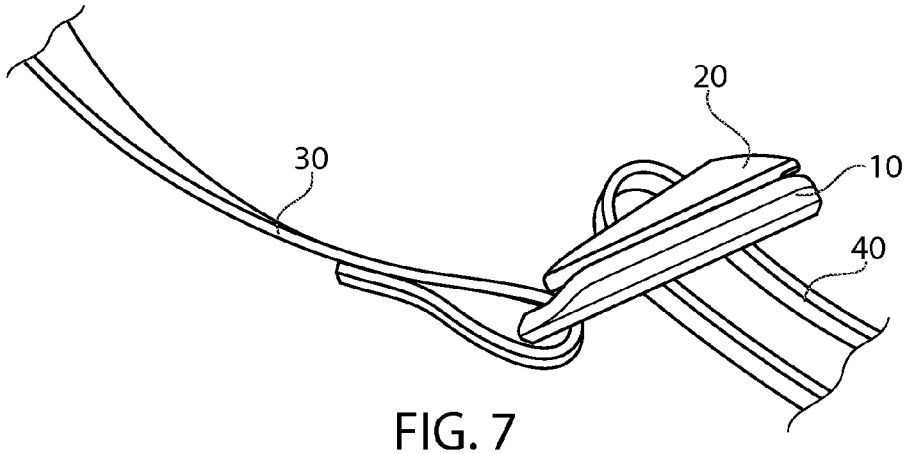
FIG. 7 shows a side view of the buckle assembly in a locked position.
Figure 8:
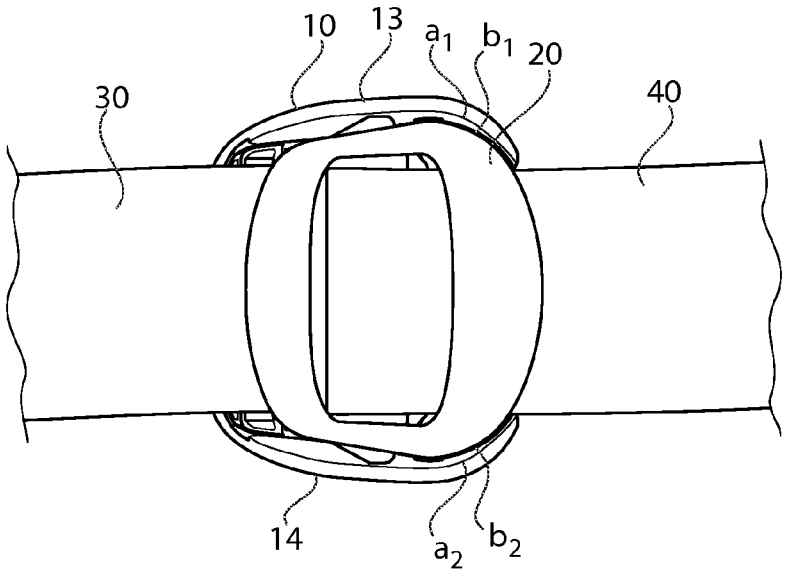
FIG. 8 shows a top view of the buckle assembly in a locked position.

Pulling on straps 30 and 40 forces locking portion 20 down onto the top surface 11 of base portion 10, as shown in FIGS. 7 and 8. Because locking portion 20 has a length $l_2$ that is greater than the length $l_1$ of opening 15, locking portion 20 cannot pass through opening 15 while the two portions 10, 20 are disposed parallel to each other. This creates a first level of locking, where locking portion 20 cannot inadvertently become disengaged from base portion 10.

Figure 9:
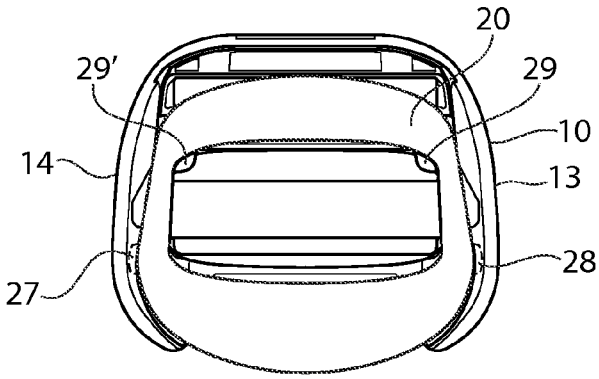
FIG. 9 shows a top view of the buckle assembly, showing the interior locking mechanism in broken lines.

In addition to forcing the two portions together, pulling on straps 30, 40, also causes protrusions 27, 28 on locking portion 20 to snap into slots 18, 19, of base portion 10, as shown in FIG. 9. This creates a second level of locking between base portion 10 and locking portion 20. Slots 18, 19 are disposed on an interior surface of side walls 13, 14 of base portion 10, and are positioned to be located directly adjacent protrusions 27, 28 when locking portion 20 is placed over base portion 10. The interaction of the protrusions 27, 28 with slots 18, 19 prevents locking portion 20 from becoming disengaged from base portion 10, even when the straps are released. To release buckle assembly 1, locking portion 20 must be lifted up off of base portion 10 until the protrusions 27, 28 snap out of slots 18, 19. Then, locking portion can be rotated to be substantially perpendicular with base portion 10 and slid back down through opening 15 to separate the two portions.

The interior contour $a_1$, $a_2$ of side walls 13, 14 of base portion 10 are configured to correspond to the outside contour $b_1$, $b_2$ of locking portion 20, so that locking portion 20 can seat securely within side walls 13, 14, as shown in FIG. 8. This also acts to guide locking portion 20 into the proper position for snapping protrusions 27, 28 into slots. 18, 19 of base portion 10. Thus, pulling on straps 30, 40 can force locking portion 20 into the proper position within side walls 13, 14, and snap the protrusions 27, 28 into slots 18, 19 in one step. Off-center positioning of locking portion 20 is not possible with this configuration. The base portion has an indentation 31 on its edge so that locking portion 20 overlaps base portion 10 when the two portions are locked together. This way, it is simple to release the two portions by pressing upward on locking portion 20 from underneath base portion 10 in the area of indentation 31 (See FIG. 2).

Also located on locking portion 20 are two additional protrusions 29, 29' (see FIG. 3), which extend into cavity 23 opposite strap retaining bar 24. These protrusions 29, 29' act instead of an additional strap retaining bar to secure strap 40 to locking portion 20. Leaving space in between the 2 protrusions provides room for strap 40 to create a belly and forces the strap 40 to press against the corner of the protrusions 29, 29' to create friction. This allows the strap 40 to hold the locking portion 20 in position at a fixed angle and avoid sliding along strap 40 prior to assembly.

In addition, apart from preventing strap dislocation, protrusions 29, 29' can also facilitate the assembling of strap 40 and locking portion 20. Bag or apparel factories usually insert the locking portions before sewing the folded webbing ends. Using protrusions 29, 29', instead of using a bar or narrowing the slot for the webbing to pass through, can avoid this problem by allowing the already-folded webbing to be inserted through the locking portion 20. Traditional bars or narrowing slots would not allow this. The present invention therefore reduces assembly costs.

Figure 10:
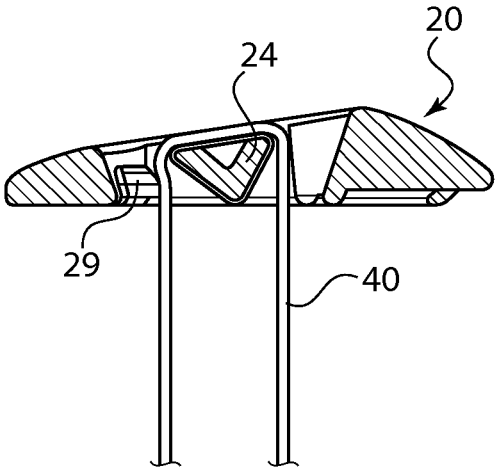
FIG. 10 shows a cross-sectional view of the locking portion with a strap attached, showing how the male portion is held at a fixed angle with the strap.
Figure 11:
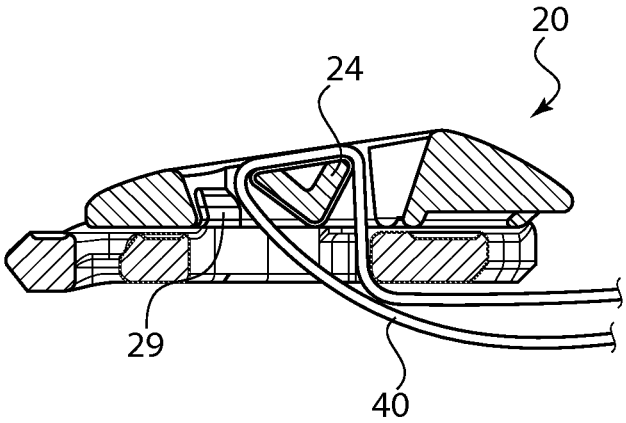
FIG. 11 shows a cross-sectional view of the buckle assembly with a strap attached.

In addition, protrusions 29, 29' extend only a portion of the height of locking portion 20, as shown in FIGS. 10 and 11. This allows the strap 40 to change direction as it passes through locking portion 20, as shown in FIG. 10. This prevents excessive friction on the strap by providing additional space around the strap, while providing enough friction to keep the strap in place. In addition, when locking portion 20 is connected to base portion 11 as shown in FIG. 11, the geometry and position of protrusions 29, 29' drive strap 40 away from protrusions 29, 29' and ensure a smooth and efficient adjustment of strap 40.

Accordingly, while only a few embodiments of the present invention have been shown and described, it is obvious that many changes and modifications may be made thereunto without departing from the spirit and scope of the invention.

What is claimed is:

1. A buckle assembly, comprising:

a base portion having a top surface, a bottom surface, side walls, a strap retaining bar disposed between the side walls and an opening disposed between the side walls, the opening having a width extending between the side walls and a length extending perpendicular to the width;

a locking portion having opposing side walls, a cavity between the side walls, a strap retaining bar disposed within the cavity and extending between the side walls of the locking portion, the locking portion having a width extending from one of the side walls to the other of the side walls, and a length extending perpendicular to the width of the locking portion;

a strap disposed over the strap retaining bar of the locking portion, such that when the locking portion is connected to the base portion, ends of the strap extend through the cavity of the locking portion and the opening of the base portion;

wherein the length of the locking portion is greater than the length of the opening, and wherein the width of the opening at a widest point is wider than the width of the locking portion at a widest point thereof;

wherein the side walls of only one of the locking portion and the base portion each have a single locking protrusion disposed thereon;

wherein the side walls of only one of the other of the base portion and the locking portion each have a single slot arranged to accommodate the single locking protrusion on each side wall of the locking portion or base portion when the locking portion is placed on the top surface of the base portion, the slots and locking protrusions engaging in a snap-fit manner;

wherein the locking portion is adapted to be connected to the base portion by sliding the locking portion entirely through the opening from the bottom surface to the top surface of the base portion, aligning the locking portion to extend parallel to the top surface of the base portion, creating a first level of locking, and snapping the locking protrusions into the slots, creating a second level of locking, and wherein the second level of locking is accomplished by pulling the ends of the strap in a direction parallel to the top and bottom surfaces of the base portion and locking portion when the locking portion is disposed above the base portion, to cause the locking protrusions to snap into the slots and lock the locking portion to the base portion;

wherein there are two frictional protrusions disposed one each on the side walls of the locking portion adjacent the strap retaining bar, wherein feeding the strap between the strap retaining bar and the frictional protrusions causes edges of the strap to press against the frictional protrusions and keep the strap in place during manufacturing and assembly of the buckle assembly, and wherein the frictional protrusions have a height that is less than a height of the side walls of the locking portion and strap retaining bar.

2. The buckle assembly according to claim 1, wherein the side walls of the base portion have a curved inner contour that corresponds to a shape of a curved outer contour of the locking portion, so that the locking portion seats within the side walls of the base portion when the base portion and locking portion are locked together.

3. The buckle assembly according to claim 1, wherein the strap retaining bar of the base portion is disposed at one end of the base portion.

4. The buckle assembly according to claim 1, wherein the base portion has an indentation on one end so that the locking portion extends beyond the indentation when the base portion and locking portion are locked together.

* * * * *